United States Patent [19]

Mangan et al.

[11] Patent Number: 4,470,445

[45] Date of Patent: Sep. 11, 1984

[54] APPARATUS FOR POURING HOT TOP INGOTS BY WEIGHT

[75] Inventors: Edmund L. Mangan, Bethlehem, Pa.; Eldon B. Shelly, Cockevsville, Md.

[73] Assignee: Bethlehem Steel Corp., Bethlehem, Pa.

[21] Appl. No.: 348,894

[22] Filed: Feb. 16, 1982

Related U.S. Application Data

[63] Continuation of Ser. No. 125,736, Feb. 28, 1980, abandoned.

[51] Int. Cl.[3] ..... B22D 2/00

[52] U.S. Cl. ..... 164/156; 164/155

[58] Field of Search ..... 164/4.1, 457, 155, 156; 222/594, 595, 596, 55, 58

[56] References Cited

U.S. PATENT DOCUMENTS

| | | | |
|---|---|---|---|
| 2,753,605 | 10/1956 | Carlton, Jr. | 164/4.1 |
| 3,096,550 | 1/1963 | Greffe et al. | 164/4.1 |
| 3,319,728 | 5/1967 | Johansson et al. | 164/155 X |
| 3,395,908 | 8/1968 | Woodcock | 266/99 |
| 3,599,835 | 8/1977 | Kocks | 222/58 |
| 3,643,724 | 2/1972 | Lee | 164/4.1 |
| 3,818,971 | 6/1974 | Schutz | 164/4.1 |
| 3,834,587 | 9/1974 | Benet et al. | 164/155 X |
| 3,941,281 | 3/1976 | Hind | 164/155 X |
| 4,019,503 | 4/1977 | Bergman et al. | 164/155 |
| 4,019,562 | 4/1977 | Shiraiwa et al. | 164/155 |
| 4,079,501 | 3/1978 | Harris | 164/76.1 |
| 4,134,444 | 1/1979 | Fujie et al. | 164/155 |
| 4,160,168 | 7/1979 | Funck | 164/4.1 X |
| 4,210,192 | 7/1980 | Lavanchy et al. | 164/155 X |

*Primary Examiner*—Nicholas P. Godici
*Assistant Examiner*—P. Weston Musselman, Jr.
*Attorney, Agent, or Firm*—John J. Selko

[57] ABSTRACT

Ingot yield is improved by changing teeming practice to pouring ingot body and hot top by weight rather than by volume to a mark on a hot top casting. Correct weight addition to the ingot hot top is calculated by a computerized weight-loss weigher system using either a value related to ingot mold body size or a precentage of body weight. Calculation is initiated either manually or automatically when hot metal level is detected at the bottom of the hot top casting.

4 Claims, 9 Drawing Figures

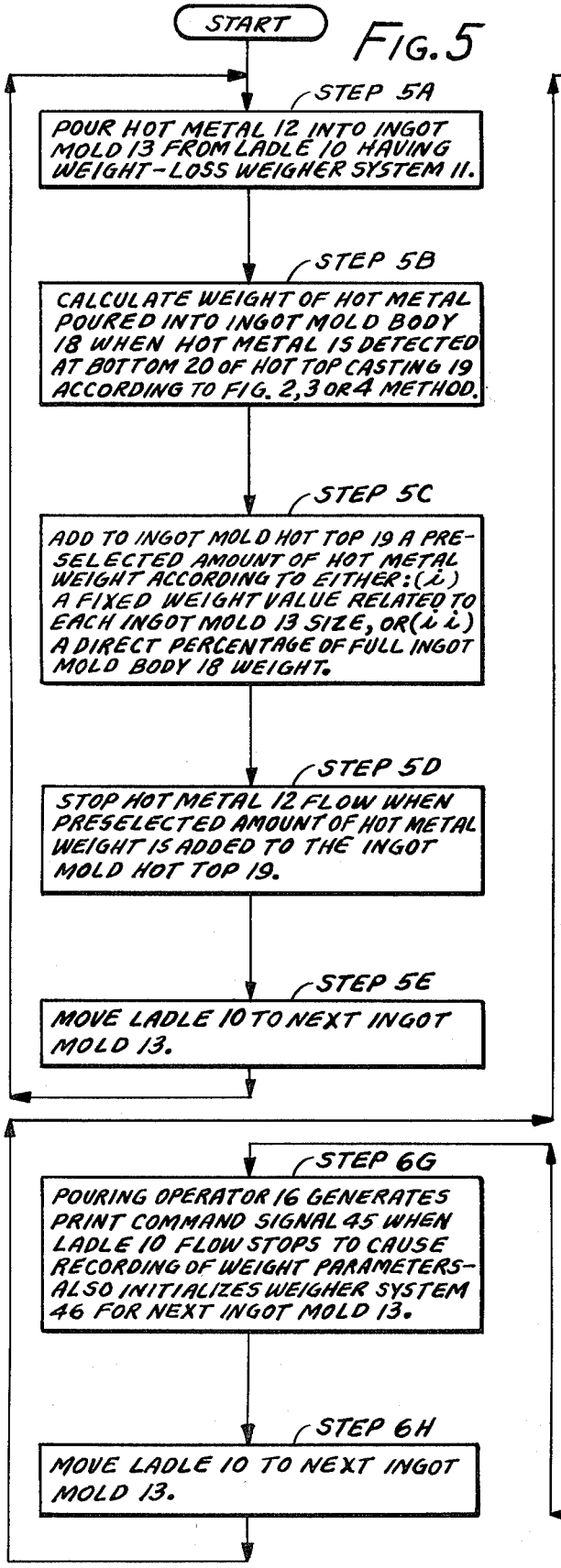
START
FIG. 5
STEP 5A
POUR HOT METAL 12 INTO INGOT MOLD 13 FROM LADLE 10 HAVING WEIGHT-LOSS WEIGHER SYSTEM 11.
STEP 5B
CALCULATE WEIGHT OF HOT METAL POURED INTO INGOT MOLD BODY 18 WHEN HOT METAL IS DETECTED AT BOTTOM 20 OF HOT TOP CASTING 19 ACCORDING TO FIG. 2,3 OR 4 METHOD.
STEP 5C
ADD TO INGOT MOLD HOT TOP 19 A PRE-SELECTED AMOUNT OF HOT METAL WEIGHT ACCORDING TO EITHER: (i) A FIXED WEIGHT VALUE RELATED TO EACH INGOT MOLD 13 SIZE, OR (ii) A DIRECT PERCENTAGE OF FULL INGOT MOLD BODY 18 WEIGHT.
STEP 5D
STOP HOT METAL 12 FLOW WHEN PRESELECTED AMOUNT OF HOT METAL WEIGHT IS ADDED TO THE INGOT MOLD HOT TOP 19.
STEP 5E
MOVE LADLE 10 TO NEXT INGOT MOLD 13.
STEP 6G
POURING OPERATOR 16 GENERATES PRINT COMMAND SIGNAL 45 WHEN LADLE 10 FLOW STOPS TO CAUSE RECORDING OF WEIGHT PARAMETERS-ALSO INITIALIZES WEIGHER SYSTEM 46 FOR NEXT INGOT MOLD 13.
STEP 6H
MOVE LADLE 10 TO NEXT INGOT MOLD 13.

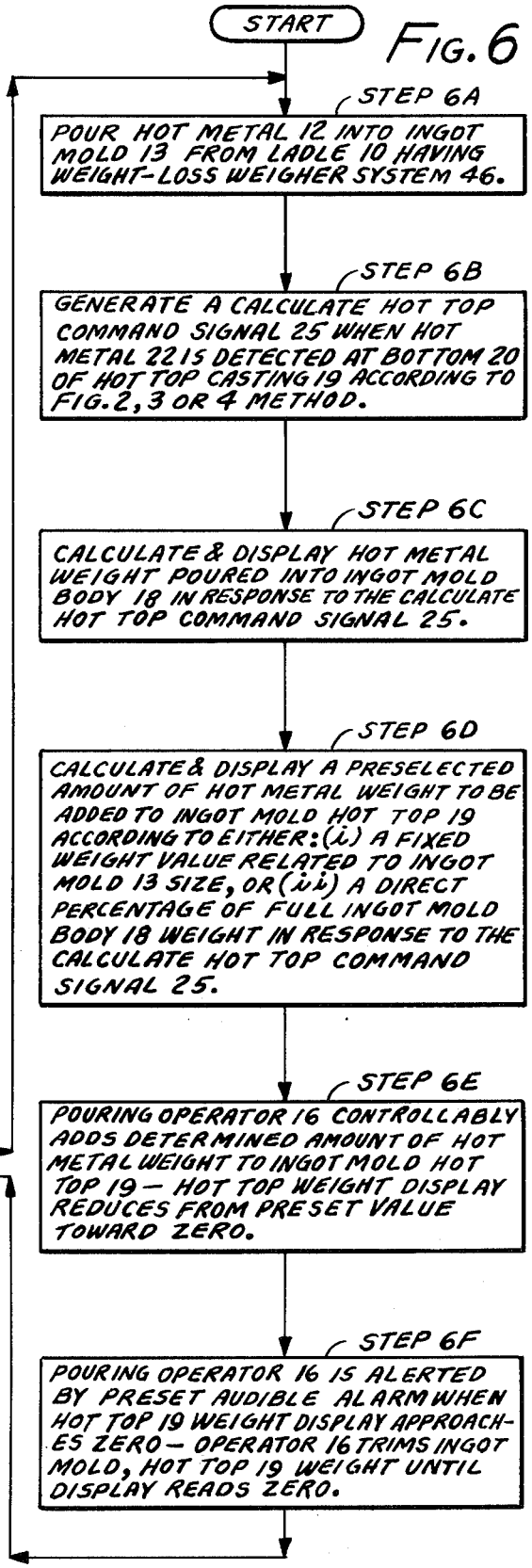
START
FIG. 6
STEP 6A
POUR HOT METAL 12 INTO INGOT MOLD 13 FROM LADLE 10 HAVING WEIGHT-LOSS WEIGHER SYSTEM 46.
STEP 6B
GENERATE A CALCULATE HOT TOP COMMAND SIGNAL 25 WHEN HOT METAL 22 IS DETECTED AT BOTTOM 20 OF HOT TOP CASTING 19 ACCORDING TO FIG. 2, 3 OR 4 METHOD.
STEP 6C
CALCULATE & DISPLAY HOT METAL WEIGHT POURED INTO INGOT MOLD BODY 18 IN RESPONSE TO THE CALCULATE HOT TOP COMMAND SIGNAL 25.
STEP 6D
CALCULATE & DISPLAY A PRESELECTED AMOUNT OF HOT METAL WEIGHT TO BE ADDED TO INGOT MOLD HOT TOP 19 ACCORDING TO EITHER: (i) A FIXED WEIGHT VALUE RELATED TO INGOT MOLD 13 SIZE, OR (ii) A DIRECT PERCENTAGE OF FULL INGOT MOLD BODY 18 WEIGHT IN RESPONSE TO THE CALCULATE HOT TOP COMMAND SIGNAL 25.
STEP 6E
POURING OPERATOR 16 CONTROLLABLY ADDS DETERMINED AMOUNT OF HOT METAL WEIGHT TO INGOT MOLD HOT TOP 19 — HOT TOP WEIGHT DISPLAY REDUCES FROM PRESET VALUE TOWARD ZERO.
STEP 6F
POURING OPERATOR 16 IS ALERTED BY PRESET AUDIBLE ALARM WHEN HOT TOP 19 WEIGHT DISPLAY APPROACHES ZERO — OPERATOR 16 TRIMS INGOT MOLD, HOT TOP 19 WEIGHT UNTIL DISPLAY READS ZERO.

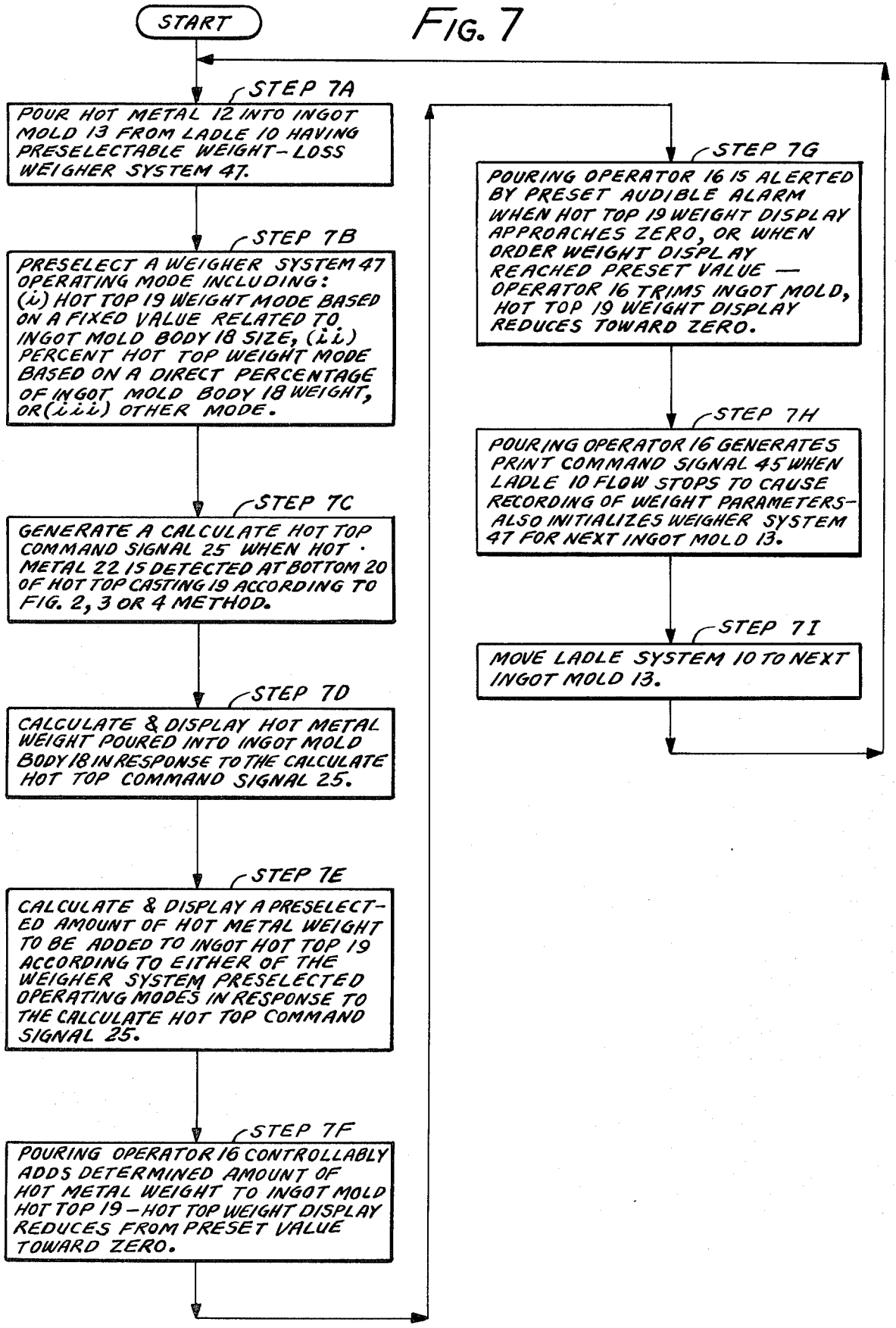
START
FIG. 7
STEP 7A
POUR HOT METAL 12 INTO INGOT MOLD 13 FROM LADLE 10 HAVING PRESELECTABLE WEIGHT-LOSS WEIGHER SYSTEM 47.
STEP 7B
PRESELECT A WEIGHER SYSTEM 47 OPERATING MODE INCLUDING: (i) HOT TOP 19 WEIGHT MODE BASED ON A FIXED VALUE RELATED TO INGOT MOLD BODY 18 SIZE, (ii) PERCENT HOT TOP WEIGHT MODE BASED ON A DIRECT PERCENTAGE OF INGOT MOLD BODY 18 WEIGHT, OR (iii) OTHER MODE.
STEP 7C
GENERATE A CALCULATE HOT TOP COMMAND SIGNAL 25 WHEN HOT METAL 22 IS DETECTED AT BOTTOM 20 OF HOT TOP CASTING 19 ACCORDING TO FIG. 2, 3 OR 4 METHOD.
STEP 7D
CALCULATE & DISPLAY HOT METAL WEIGHT POURED INTO INGOT MOLD BODY 18 IN RESPONSE TO THE CALCULATE HOT TOP COMMAND SIGNAL 25.
STEP 7E
CALCULATE & DISPLAY A PRESELECTED AMOUNT OF HOT METAL WEIGHT TO BE ADDED TO INGOT HOT TOP 19 ACCORDING TO EITHER OF THE WEIGHER SYSTEM PRESELECTED OPERATING MODES IN RESPONSE TO THE CALCULATE HOT TOP COMMAND SIGNAL 25.
STEP 7F
POURING OPERATOR 16 CONTROLLABLY ADDS DETERMINED AMOUNT OF HOT METAL WEIGHT TO INGOT MOLD HOT TOP 19 – HOT TOP WEIGHT DISPLAY REDUCES FROM PRESET VALUE TOWARD ZERO.
STEP 7G
POURING OPERATOR 16 IS ALERTED BY PRESET AUDIBLE ALARM WHEN HOT TOP 19 WEIGHT DISPLAY APPROACHES ZERO, OR WHEN ORDER WEIGHT DISPLAY REACHED PRESET VALUE — OPERATOR 16 TRIMS INGOT MOLD, HOT TOP 19 WEIGHT DISPLAY REDUCES TOWARD ZERO.
STEP 7H
POURING OPERATOR 16 GENERATES PRINT COMMAND SIGNAL 45 WHEN LADLE 10 FLOW STOPS TO CAUSE RECORDING OF WEIGHT PARAMETERS – ALSO INITIALIZES WEIGHER SYSTEM 47 FOR NEXT INGOT MOLD 13.
STEP 7I
MOVE LADLE SYSTEM 10 TO NEXT INGOT MOLD 13.

APPARATUS FOR POURING HOT TOP INGOTS BY WEIGHT

This is a continuation, of application Ser. No. 06/125,736, filed 2/28/80 abandoned.

BACKGROUND OF THE INVENTION

1. Field of the Invention

This invention relates broadly to a method and apparatus for pouring ingots, and more particularly for pouring hot top ingots by weight instead of volume.

2. Description of the Prior Art

In the production of steel ingots, for example, ingots are ordered according to metallurgical grade, weight and size. Generally, depending on metallurgical grade, the teeming practice uses one of three types of ingot molds. Hot metal is poured into either a bottle cap ingot mold of fixed volume, or either an open-top or hot-top ingot mold of variable volume. A similar teeming practice is used in other metal industries.

An improvement in teeming practice occurred recently when a teeming ladle having a weight-loss weigher system was used to pour open top ingots by ordered weight rather than by volume. However, when using this practice on hot top ingot molds, the ingot mold body was poured by weight, but the ingot hot top was still poured by volume to a mark in the hot top casting. This was because of the unavailability of a weigher system to do otherwise. Using the recent practice, only the correct ingot body weight was achieved. Only a theoretically correct hot top addition was made, this being based on volume and not weight, with the expectation of providing enough liquid steel to fill the shrinkage cavity in the ingot mold body as the metal freezes.

There are some sources of considerable errors when using the volume-based teeming practice, regardless of whether an operator pours hot metal into ingot bodies alone, or into open-top or hot-top ingot molds. In any production operation where ingot molds are reused, ingot mold volume changes due to mold and/or stool wear. This causes a corresponding change in apparent mold body volume and carries over to a hot top volume variation. Further, when teeming to a mark in the ingot hot top casting, which is difficult for a pouring operator to see, the steel volume added to the ingot hot top is another source of volume error.

In order to compensate for these volume errors and insure that metallurgically sound steel will exist in the ingot mold body, it generally is the practice of pouring operators to add extra steel to the ingot hot top. In primary mills that follow pouring, the ingot is rolled and the top portion is cropped and scrapped. It has been discovered that the weight of scrapped ingot tops poured by the volume pouring method varies from slightly less than 10% to greater than 15% of ingot body weight. This variation is attributed to one or more sources of error caused by ingot mold/stool size wear, variable hot top allowances and the inability of the pouring operator to stop hot metal flow into the ingot at the correct height.

SUMMARY OF THE INVENTION

A main object of this invention is to provide an improved method and apparatus for pouring ingots that will overcome the foregoing difficulties.

One other object of this invention is to provide an improved method and apparatus for pouring ingots that will yield tonnage savings in both old and new mill installations.

Another object of this invention is to provide an improved method and apparatus for pouring ingots that will accommodate various ingot mold sizes and configurations.

Still another object of this invention is to provide an improved method and apparatus for pouring hot top ingots by weight rather than volume.

A final object of this invention is to provide an improved method and apparatus for determining ingot body and hot top weights that will improve ingot pouring yield.

The foregoing objects may advantageously be achieved by using a teeming ladle having a preselectable weight-loss weigher system which is arranged for determining ingot body weight, or net weight, as a function of ladle net weight-loss; and controllably adding to the ingot body weight an amount of ingot hot top metal weight selectively determined by weigher system computer means using either a preselected fixed weight value related to ingot body size, or a preselected variable weight value based on a direct percentage of the determined ingot body weight, preferably the latter. The weigher system is further arranged to initiate calculation of the correct weight addition, either manually or automatically, when hot metal level is detected at the bottom of a hot top casting. Means are provided for displaying and recording of gross weight remaining in the ladle, ingot body and/or hot top weights or total hot top ingot weight, and the preselected percentage multiplier or fixed weight value added to the ingot hot top.

BRIEF DESCRIPTION OF THE DRAWINGS

FIGS. 5, 6 and 7 are flow charts of different methods of implementing the present invention.

DESCRIPTION OF THE PREFERRED EMBODIMENT

Figure 1:
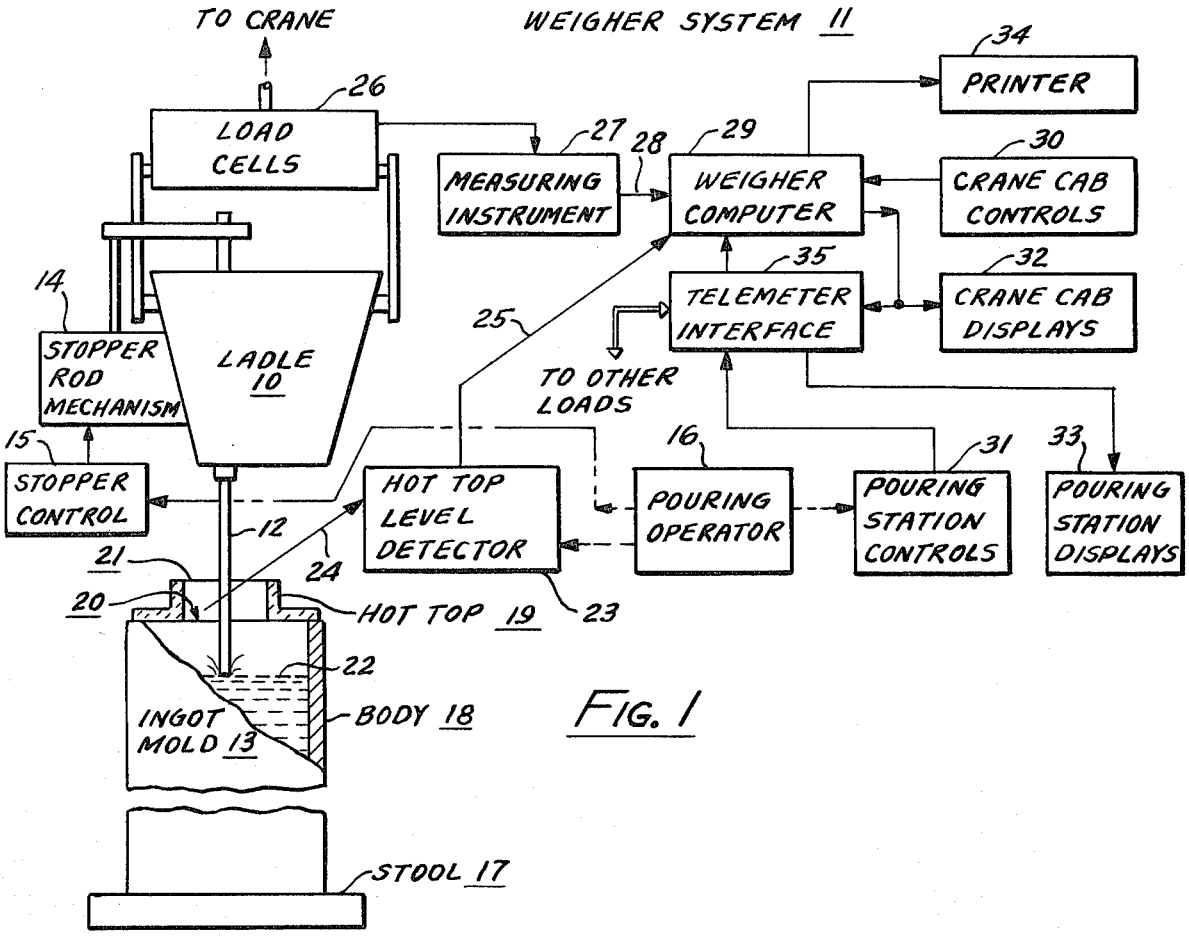
FIG. 1 is a block diagram of an overall ingot pouring installation with computerized weight-loss weigher system illustrative of the present invention.

Referring now to the drawings, particularly FIG. 1, there is shown an ingot pouring installation where a teeming ladle, or ladle 10, is combined with weigher system 11 to pour hot metal 12 into ingot mold 13. Flow of hot metal 12 throughout the range of full, dribble and zero flow rates from ladle 10 is, for illustrative purposes, controlled by stopper rod mechanism 14 operating responsive to stopper control 15. Other conventional hot metal flow control devices may be used. Stopper control 15 is acted upon by pouring operator 16, usually a person having the clearest view of the ingot pouring operation and is responsible for the same.

Figure 2:
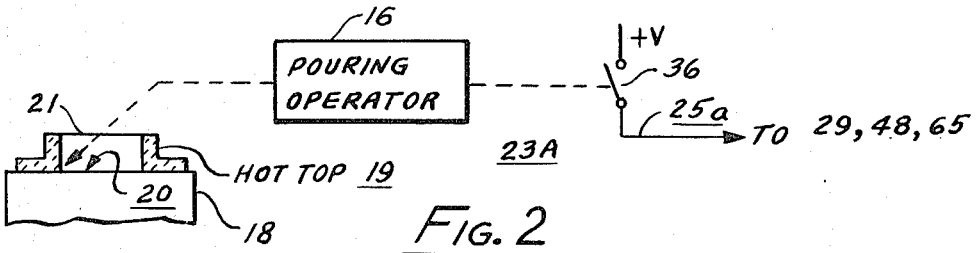
FIGS. 2, 3 and 4 are block diagrams of respective manual and automatic methods of detecting hot metal level at the bottom of a hot top casting as used in the FIG. 1 embodiment.
Figure 3:
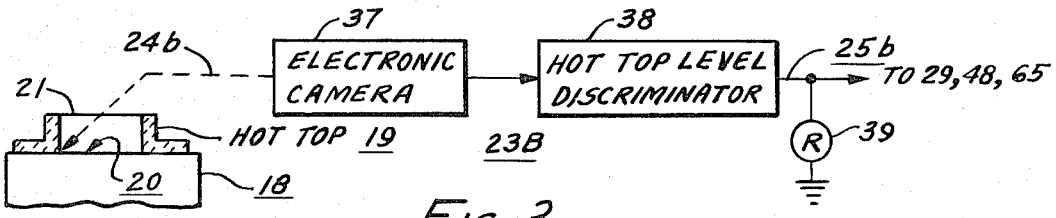
Figure 4:
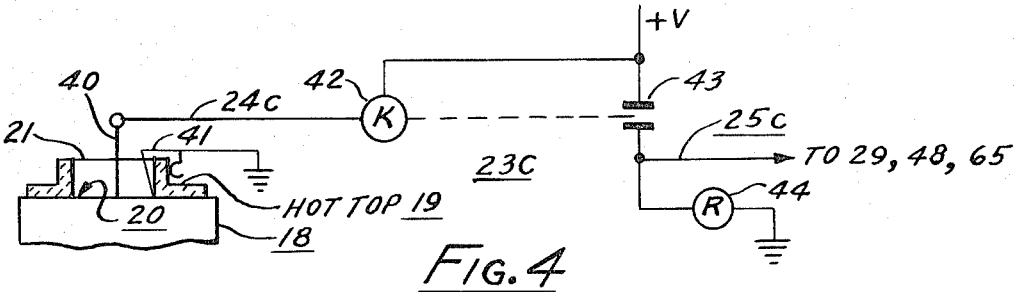

Ingot mold 13 comprises a stool 17, a body 18 and a hot top casting 19 having bottom and top edges 20, 21, respectively, all generally of conventional design. As hot metal level 22 rises in ingot mold body 18 it is sensed by hot top level detector 23 which may be one of three embodiments 23A, 23B, 23C, one manual and two automatic, as shown in FIGS. 2, 3 and 4 described below. When hot metal level 22 is sensed via line 24 at the bottom edge 20 of ingot hot top casting 19, the hot top level detector 23 generates a calculate hot top command signal on line 25 in weigher system 11. As will be described below, the signal on line 25 is used to initiate a determination of the amount of hot metal weight addition to hot top casting 19.

Figure 8:
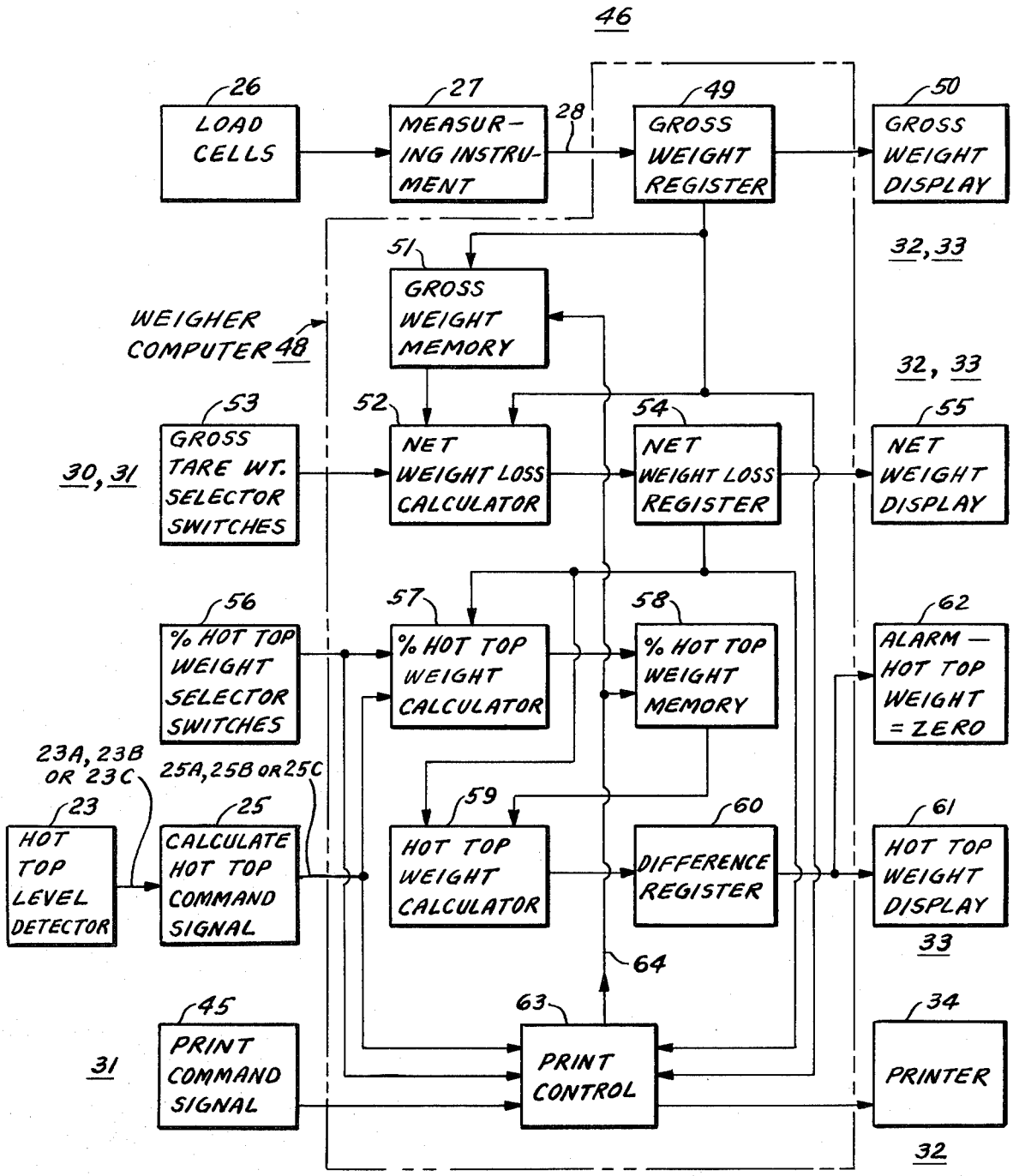
FIGS. 8 and 9 are block diagrams of different weigher system apparatus for implementing the present invention.
Figure 9:
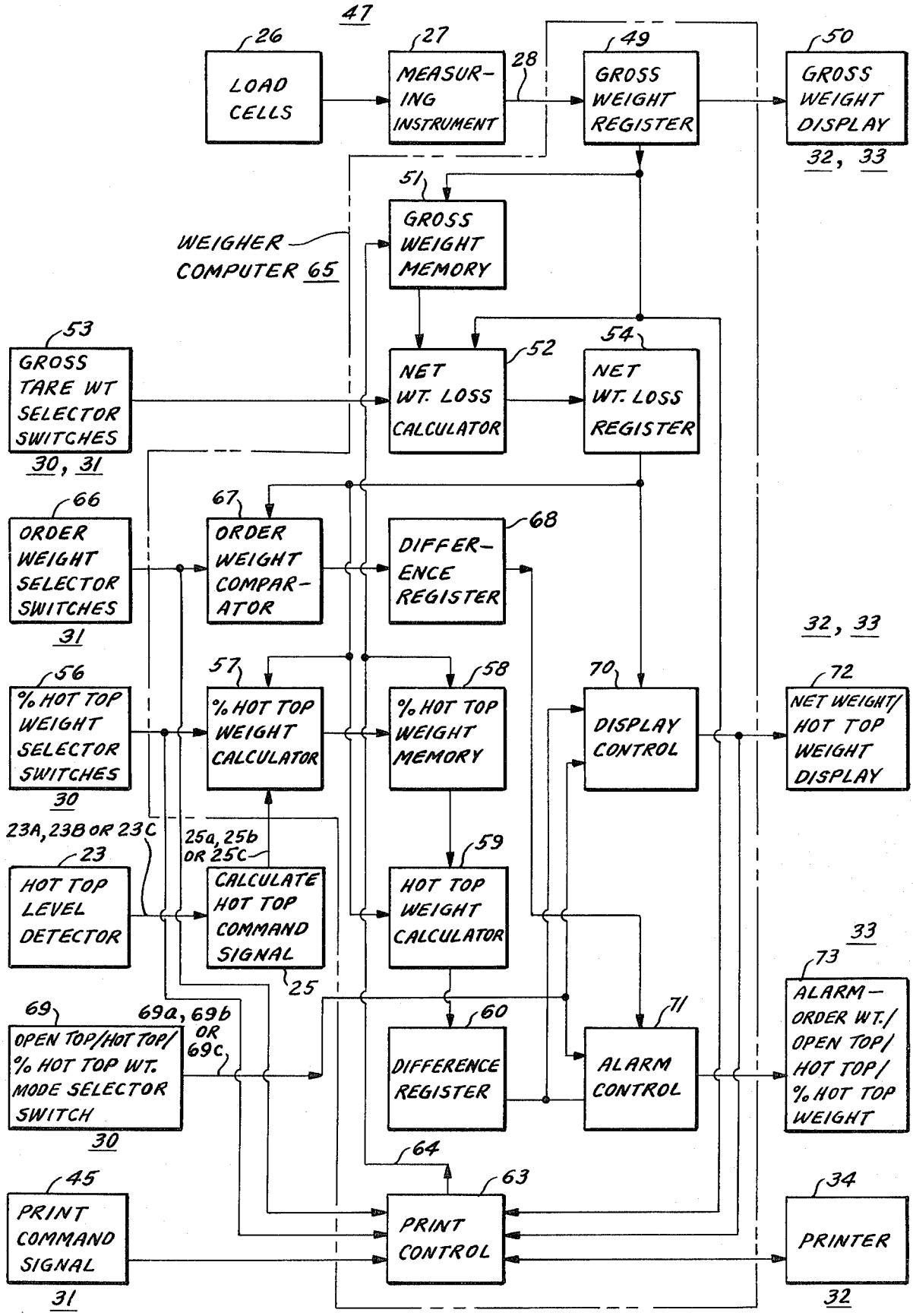

Weigher system 11 is actually a conventional weightloss weigher system modified as shown in FIGS. 8 and 9 and described below. Weigher system 11, as shown in FIG. 1, includes means for sensing ladle 10 weight, such as a structure of one or more load cells 26 interconnecting ladle 10 and a teeming crane not shown. Load cells 26 outputs are fed to measuring instrument 27 where they are conditioned, zeroed and combined as one signal representative of ladle gross weight appearing on line 28. Weigher system 11 also includes weigher computer 29 which is located, for example, in a crane cab not shown. Weigher computer 29 receives the ladle gross weight signal over line 28, the calculate hot top command signal on line 25, one or more preselected weight data inputs from crane cab controls 30 and/or pouring station controls 31, and one of three operating mode signals from crane cab controls 30. Weigher computer 29 is arranged to determine either ladle gross weight, preselected order weight, preselected ingot body net weight, a preselected fixed, percentage, or other amount of hot top 19 metal weight addition to the ingot body 18 weight, or any combination of these parameters, as well as dribble and stop alarms. Weigher computer 29 outputs the one or more weight data parameters to crane cab displays 32 and/or pouring station displays 33, each location including alarms, and to printer 34 as desired. Telemeter interface 35 provides a bidirectional radio voice and data link between weigher computer 29 in the crane cab and pouring station controls, alarms and displays 31, 33, respectively, and other loads such as a process control computer not shown. A detailed disclosure of weigher computers for simple and more complex determinations of ingot body weight and hot top weight addition parameters are in FIGS. 8 and 9 which are described below.

Turning now to FIGS. 2, 3 and 4, there are shown three embodiments 23A, 23B, 23C, one manual and two automatic, of hot top level detector 23, any one of which is used in weigher system 11 to generate the calculate hot top command signal that appears on line 25*a*, 25*b*, 25*c*, respectively. In each embodiment, it is assumed that ingot mold body 18 is being weighed as it is filled and when hot metal level 22 rises to the bottom edge 20 of ingot hot top casting 19 the hot top level detection function will occur. Further, that as weigher computer 29 determines the correct weight amount, preferably as a percentage of ingot body weight, that this amount will be displayed, either as a weight or a weightloss parameter, and this display will be used by pouring operating 16 to act on stopper control 15 and prevent hot metal level 22 from rising beyond the top edge 21 of ingot hot top casting 19.

In FIG. 2 a manual hot top level detector 23A is shown which involves pouring operator 16 sensing the hot metal level 22 along line 24*a* at the bottom edge 20 and closing pushbutton 36 to generate a calculate hot top command signal on line 25*a* that is fed to weigher computer 29.

In FIG. 3 an automatic electrooptical hot top level detector 23B is shown which uses an electronic camera 37 to sense the hot metal level 22 along line 24*b* at the bottom edge 20. Camera 37 causes hot top level discriminator 38 to generate a calculate hot top command signal on line 25*b* that is fed to both weigher computer 29 and an indicator light 39 which instructs pouring operator 16 that such level has been detected.

In FIG. 4 an automatic electrical hot top level detector 23C is shown which uses a pair of insulated electrodes 40, 41 which form an electrical contact closure when hot metal level 22 shorts their lower ends at bottom edge 20 of hot top casting 19. Electrode 41 is shown grounded and electrode 40 is connected via line 24*c* to relay coil 42, which coil causes relay contacts 43 to close and generate a calculate hot top command signal on line 25*c*. This signal is fed to both weigher computer 29 and an indicator light 44 which instructs pouring operator 16 that such level has been detected.

Reference will now be made to FIGS. 5, 6 and 7 flow charts of simplified, intermediate and complex methods of implementing the present invention. FIG. 1 described above and FIGS. 8 and 9 described below illustrate respective simplified, intermediate and complex weigher systems for carrying out the methods of FIGS. 5, 6 and 7. In each method, the preferred embodiment of ingot mold hot top 19 weight control is based on adding steel into ingot mold hot top 19 as a preselected percentage of ingot body 18 weight, rather than volume, even though adding a fixed hot top weight value is simpler to carry out. The actual percentage weight factor preselected may vary with a wide range of ingot mold 13 sizes. However, within a given range of sizes the actual percentage weight factor preselected will be constant.

For example, an ingot mold 13 in new condition is designed to hold 25,000 lbs. of ingot body 18 weight, then 10%, or 2,500 lbs., may be determined to be the correct steel weight addition to ingot mold hot top 19. When ingot mold 13 wears to the point where it holds 26,000 pounds in ingot body 18, then 10%, or 2,600 lbs., would be added to ingot mold hot top 18 to provide adequate steel to fill the sink head. This method permits ingot mold hot tops 19 to be poured as a precise preselected percentage of ingot mold body 18 weight. This method also contains provisions for varying the preselected percentage so that the optimum amount of ingot mold hot top 19 weight addition can be determined for each ingot mold 13 size range and that amount be repeated in subsequent pourings from ladle 10 into ingot mold 13.

Certain ingot molds 13, because of their cross section-to-height ratio, or other size-to-weight relationship, do not require a constant percentage weight but rather a fixed weight addition to ingot mold hot top 19. Preselectable provisions are made in the method and apparatus of the present invention to pour hot metal into ingot mold body 18 and then into ingot mold hot top 19 to a fixed weight value.

Both the percentage and fixed-value ingot mold hot top 19 weight addition methods of FIGS. 5, 6 and 7 require teeming ladle 10 to be equipped with a weigher system 11 that will at least indicate either the loss of weight in teeming ladle 10, or the gain in net weight poured into ingot mold 13, including ingot mold body 18 weight and ingot mold hot top 19 weight. It will be assumed that weigher system 11 has been initialized so as to display zeros in an ingot weight display and zero on ingot weight register as are generally done for pouring open top ingot heats. Further, it will also be assumed that weigher system 11 is equipped with audible or visual presettable dribble and/or stop pouring alarms used by pouring operator 16 to control the flow of hot metal 12 from teeming ladle 10 into ingot mold 13.

The simplified method of FIG. 5 calls for step 5A to pour hot metal 12 into ingot mold 13 from teeming ladle 10 which has at least a minimal weight-loss weigher system 11 as mentioned above in FIG. 1. Step 5B calls for calculating ingot mold body 18 weight when hot metal level 22 is detected at bottom 20 of ingot mold top 19 according to either FIG. 2, 3 or 4 manual or automatic detection method. In step 5C there is added to ingot mold hot top 19 a preselected amount of hot metal weight according to either: (i) a fixed weight value related to each ingot mold 13 size as noted above, or (ii) preferably, a direct percentage of full ingot mold body 18 weight. Step 5D calls for stopping hot metal 12 flow into ingot mold 13 when the preselected amount of hot metal weight is added to ingot mold hot top 19. Step 5E indicates that ladle 10 should then be moved to the next ingot mold 13 and steps 5A to 5E are repeated until teeming ladle 10 is empty.

In the intermediate method of FIG. 6, step 6A calls for pouring of hot metal 12 into ingot mold 13 from teeming ladle 10 having an intermediate weight-loss weigher system 46 mentioned in FIG. 8 and described below. In step 6B, a calculate hot top command signal 25 is generated when hot metal level 22 is detected at the bottom 20 of ingot mold hot top 19 according to either FIG. 2, 3 or 4 manual or automatic detection method. Step 6C calls for calculating and displaying hot metal weight poured into ingot mold body 18 in response to the calculate hot top command signal 25, that is, when hot metal level 22 is detected at bottom 20 of ingot mold hot top 19. In step 6D there is calculated and displayed a preselected amount of hot metal weight to be added to ingot mold hot top 19 according to either: (i) a fixed weight value related to ingot mold 13 size, or (ii) a direct percentage of full ingot mold body 18 weight in response to the calculate hot top command signal 25.

Step 6E involves pouring operator 16 in controllably adding the determined amount of hot metal weight to ingot mold hot top 19. Meanwhile, a hot top 19 weight display reduces from a preset value toward zero. In step 6F, pouring operator 16 is alerted by a preset audible dribble alarm when hot top 19 weight approaches zero. Pouring operator 16 trims hot top 19 weight until hot top display reads zero, at which time a stop alarm is sounded. Step 6G calls for pouring operator 16 to stop flow of hot metal 12 from teeming ladle 10 into ingot mold 13 and generate a print command signal 45 to cause a recording of weight parameters. The print command signal 45 also initializes weigher system 46 for pouring into the next ingot mold 13. Finally, in step 6H the teeming ladle 10 is moved to the next ingot mold 13 and steps 6A to 6H are repeated until teeming ladle 10 is empty.

As for the complex method of FIG. 7, step 7A calls for pouring of hot metal 12 into ingot mold 13 from teeming ladle 10 having a complex weight-loss weigher system 47 mentioned above and described in FIG. 9 below. In step 7B, there is preselected a weigher system operating mold including: (i) hot top 19 weight mode based on a fixed value related to ingot mold 13 size, (ii) percent hot top 19 weight mode based on a direct percentage of ingot mold body 18 weight, or (iii) other mode. Step 7C involves generating a calculate hot top command signal 25 when hot metal level 22 is detected at the bottom 20 of ingot mold hot top 19 according to either FIG. 2, 3 or 4 manual or automatic detection method. Step 7D calls for calculating and displaying hot metal weight poured into ingot mold body 18 in response to the calculate hot top command signal 25, in other words, when hot metal level 22 is detected at the bottom 20 of ingot mold hot top 19. In step 7E, there is calculated and displayed a preselected amount of hot metal weight to be added to ingot mold hot top 19 according to either one of the weigher system 11 preselected operating modes, said step 7E occurring in response to the calculate hot top command signal 25.

Step 7F involves pouring operator 16 in controllably adding the determined amount of hot metal weight to ingot mold hot top 19. In the meantime, a hot top 19 weight display reduces from a preset value toward zero. In step 7G, pouring operator is alerted by a preset audible dribble alarm when hot top 19 weight approaches zero, or when an ingot order weight display reaches a preset value. Pouring operator trims ingot mold hot top 19 as a hot top weight display reduces toward zero, at which time a stop alarm is sounded. Step 7H calls for pouring operator 16 to stop flow of hot metal 12 from teeming ladle 10 into ingot mold 13 and generate a print command signal 45 to cause a recording of weight parameters. The print command signal 45 also initializes weigher system 47 for pouring into the next ingot mold 13. Finally, in step 7I, the teeming ladle 10 is moved to the next ingot mold 13 and steps 7A to 7I are repeated until teeming ladle 10 is empty.

Turn now to FIGS. 8 and 9 where block diagrams show intermediate and complex weigher systems 46, 47, respectively, for carrying out the FIG. 6 and 7 method embodiments described above. A telemeter interface 35 has been omitted from FIGS. 8 and 9 to simplify weigher system 46, 47 illustration. In each weigher system 46, 47, the preferred embodiment of weight control of hot top ingots is based on adding steel into hot top 19 as a preselected percentage of ingot body 18 weight, rather than volume, even though adding a fixed hot top weight value is simpler to carry out in the weigher system. The actual preselection basis of either a variable percentage weight factor or the fixed weight factor is the same as described above under FIGS. 5 to 7 method embodiments.

The intermediate weigher system 46 of the FIG. 8 embodiment uses much the same components as the FIG. 1 simplified weigher system 11. These same components include load cells 26 for sensing teeming ladle 10 weight, measuring instrument 27, hot top level detector 23A, 23B, or 23C, calculate hot top command signal source 25, and crane cab and pouring station controls 30, 31 and displays 32, 33, respectively, printer 34 and print command signal 45, all as described above. Intermediate weigher system 46 also includes a new weigher computer 48 which includes more components than the minimal computer 29 in FIG. 1. Weigher computer 48 performs gross weight, net weight and percent hot top weight alarm function, and weight parameter printing functions, all as described below. In the description that follows, it is assumed that weigher system 46 has been initialized the same as weigher system 11 described above.

Weigher computer 48 receives as a first input a ladle gross weight signal from measuring instrument 27. The ladle gross weight signal varies proportional to the weight sensed by load cells 26 between ladle 10 empty and full conditions. This variable ladle gross weight signal accumulates in gross weight register 49, the output of which provides the weigher computer 48 first output and this is fed to gross weight display 50. In this manner, pouring operator 16, or a crane operator not shown, may observe display 50 at all times to prevent overload conditions. The output signal representing accumulation of ladle gross weight in register 49 is also fed to, and stored in, gross weight memory 51.

The ladle gross weight signal stored in memory device 51 is fed as one of three inputs to net weight loss calculator 52. The second input to net weight loss calculator 52 is the variable gross weight signal accumulating in register 49. A second input to weigher computer 48, and the third input to net weight loss calculator 52, is provided by gross tare weight selector switches 53. Selector switches 53 are preset, for example, by pouring operator 16 when observing the reading on display 50 before teeming ladle 10 is filled with hot metal. Calculator 52 determines a net weight loss signal which is accumulated from zero upward in net weight loss register 54 as the weight of hot metal poured into ingot body 18 increases. The net weight loss signal, a second output of weigher computer 48, is fed to net weight display 55 where pouring operator 16, or a crane operator, may observe the amount of hot metal weight in ingot mold body 18.

A third input to weigher computer 48 is fed from percent hot top selector switches 56 as one of two inputs to percent hot top weight calculator 57. Selector switches 56 are preset, for example, by pouring operator 16 or a crane operator, based on the desired percentage factor of ingot body 18 weight as determined above. The second input to calculator 57 is a net weight loss signal accumulated in register 54. Percent hot top weight calculator 57 is activated only when a calculate hot top command signal 25, which is provided from either source 25*a*, 25*b* or 25*c*, when generated either manually or automatically by hot top level detector 23 sensing hot metal level 22 at bottom 20 of hot top casting 19. At the moment signal 25 is generated, the signal accumulated in the net weight loss register 54, and displayed on device 55, is electronically multiplied in calculator 57 by the percentage factor preset on selector switches 56.

Thus, calculator 57 determines the percentage of ingot body 18 weight that must be added to hot top 19 in subsequent pouring to finish off ingot mold 13 and this percentage weight amount is output as a signal that is stored in percent hot top memory 58. Hot top weight calculator 59 receives the percent weight amount signal stored in memory 58 and the net weight loss signal accumulating in register 54, and determines a declining difference signal representing what the hot top 19 weight should be and the instantaneous value thereof. This difference signal provides third and fourth outputs of computer 48 which are fed respectively to hot top weight display 61 and hot top weight alarm 62. Display 61 reduces from a maximum percent-based hot top weight value toward zero as pouring operator 16 controllably adds hot metal to ingot mold hot top 19. When hot top weight display 61 reads zero, the proper hot metal weight will have been added to ingot mold hot top 19, a preset stop alarm will sound to notify pouring operator 16 to stop pouring.

When ingot pouring is completed for each ingot mold 13, pouring operator 16 generates a print command signal 45, by closure of a pushbutton or other means, which as fifth input to weigher computer 48 activates print control 63. This causes weigher computer 48 to provide a fifth output to printer 34 which provides a record of: (i) gross ladle weight remaining, (ii) total weight in the ingot mold 13, that is, ingot body weight plus ingot hot top weight, and (iii) the percentage hot top multiplier used when the calculate hot top command signal 25 was generated.

Generating the print command signal 45 also initializes weigher system 46 by producing reset signal 64 which resets gross weight memory 51 and percent hot top weight memory 58 so as to accept new data signals before pouring the next ingot mold 13. Net weight display 55 will read zero and hot top weight display 61 will read zero until a new hot top weight is determined by weigher system 46.

The FIG. 8 embodiment of weigher system 46 may be simplified to function as a preset fixed value weight system for adding hot metal weight to ingot mold hot top 19 rather than a preset percentage of ingot body 18 weight, or net weight, system described above. This involves recalibrating selector switches 56 to function as a hot top fixed-value weight parameter, instead of a percentage-weight parameter, preset by pouring operator 16. Weigher computer 48 is modified to eliminate percent hot top calculator 57, device 58 is renamed hot top weight memory 58 and is modified to store the hot top fixed-value weight preselected by selector switches 56, all in response to the calculate hot top command signal 25. Hot top weight display 61 will read from maximum hot top weight preselected toward zero, and alarm 62 will also sound when hot top 19 weight is zero. This simplified FIG. 8 weigher system 46 will also print weight parameters and be initialized when the print command signal 45 is generated as described above. The only difference being that printer 34 will record the preselected fixed value hot top weight instead of the percentage value mentioned above.

The complex weigher system 47 of the FIG. 9 embodiment replaces the simple and intermediate weigher system 11, 46 in FIGS. 1 and 8 with new preselectable weighing features. These new features include preselectable ingot order weight and preselectable weigher system operating mode, in addition to the preselectable gross tare weight and preselectable percent hot top weight features of the FIG. 8 embodiment, as well as the preselectable hot top weight alternative feature. With few exceptions, complex weigher system 47 uses all of the weigher system 11, 46 components shown in FIGS. 1 and 8 described above. One exception is that weigher system 47 includes a weigher computer 65 having added components to accommodate all of the aforesaid preselectable features, which computer replaces weigher computer 29, 48 described above. Other exceptions are the exclusion of the FIG. 8 net weight display 55, hot top display 61 and alarm device 62 in favor of new singular display and alarm devices, each of which responds to a different respective one of plural preselectable features at a time.

The FIG. 9 weigher system 47 includes hot top level detector 23, calculate hot top command signal 25 source, load cells 26, measuring instrument 27, ladle weight signal 28, crane cab and pouring station controls and displays 30 to 33, printer 34, print command signal 45 source, gross weight display 50, gross tare weight selector switches 53, percent (or alternatively fixed value) hot top weight selector switches 56, weigher computer 65 components 49, 51, 52, 54, 57 to 60, 63 and 64, these being described above and therefore will not be repeated again.

Weigher system 47 further includes order weight selector switches 66 which are preset by pouring operator 16 in accordance with the above-described basis. Selector switches 66 input to weigher computer 65 where an order weight comparator 67 compares the preset order weight with the net weight loss accumulating in register 54. Any difference between order weight and net weight loss is accumulated in difference register 68 for alarming purposes described below.

Weigher system 47 also includes weigher system mode selector switch 69 preset by an operator based on which of three ingot pouring practices are to be accommodated. Mode selector switch 69 outputs to weigher computer 65 three pouring selection control signals one at a time, namely, open top signal 69*a*, hot top signal 69*b* or the preferred percent hot top signal 69*c*, depending on which pouring practice was selected by the operator. When open top signal 69*a* is selected, order weight selector switches 66 are preset to equal the open top ingot total weight and hot top selector switches 56 are set at zero. When either hot top signal 69*b* or percent hot top signal 69*b* or 69*c* are selected, the order weight selector switches are set at total ingot weight, i.e., ingot body 18 weight plus ingot hot top weight, and the hot top selector switches 56 are set at either a fixed value weight or a percentage of ingot body weight, respectively. Regardless of which hot top selection control signal 69*b* or 69*c* is made, components in weigher computer 65, particularly hot top calculator 57 to difference register 60, will accumulate a hot top weight signal for subsequent processing after receiving the calculate hot top command signal 25.

Weigher system mode selector switch signals 69*a*, 69*b*, 69*c* are fed to control inputs of display control 70 and alarm control 71. These pouring selector signals determine whether a net weight loss signal accumulating upward in register 54 or a hot top weight signal accumulating downward in register 60 will be fed selectively to a combination net weight/hot top weight display 72. The pouring selector signals also determine whether an order weight signal accumulated in register 68 or a hot top weight signal will be fed selectively to a combination alarm for order weight/open top/hot top/percent hot top alarming functions when a respective alarm signal exceeds a preset value.

When ingot pouring is completed for each ingot mold 13, pouring operator 16 generates a print command signal 45 which activates print control 63 in weigher computer 65. This causes weigher computer 65 to output to printer 34 which in turn provides a record of : (i) gross ladle weight remaining, (ii) open top net weight or hot top ingot total weight depending on the presetting of mode selector switch 69, (iii) ingot order weight, and (iv) the percentage hot top multiplier or fixed value weight preset on selector switches 56, whichever was preselected by mode selector switch 69 and initiated by the calculate hot top command signal 25.

Generating the print command signal 45 also initializes weigher system 47 by producing reset signal 64 which resets gross weight memory 51 and percent hot top memory 58 so as to accept new data signals before pouring the next ingot mold 13. Display and alarm devices 72, 73 will also be reset to a zero value.

It should be understood that a process control computer may be programmed to substitute for the operator presetting any one or all of the gross tare weight, percent hot top weight, order weight, or weigher system mode selector switches 53, 56, 66, 69, respectively.

We claim:

1. Apparatus for pouring hot metal from a ladle into an ingot mold equipped with a hot top, said apparatus comprising:

(a) pouring means for controllably pouring the hot metal into the mold and hot top;

(b) ingot weight determining means associated with the ladle for determining the weight of hot metal in the ladle and the weight of hot metal poured into the ingot mold body;

(c) detector means for (i) detecting when the hot metal reaches the bottom of the hot top and (ii) for generating a computational command signal after the detecting;

(d) hot top weight determining means responsive to the computational command signal for determining an additional amount of metal to be added to the hot top, said additional amount being determined from either:

(i) a pre-selected fixed weight value related to the size of the ingot mold or (ii) a variable weight based upon a pre-selected percentage of the weight of hot metal poured into the ingot body as determined by the ingot weight means (b); and (e) display means for informing an operator of the amount of hot metal determined by hot top weight determining means (d) to be added to the hot top.

2. The apparatus of claim 1 wherein the level of hot metal in the ingot mold is detected by one of (i) manual and (ii) automatic means for sensing the bottom of the hot top casting and the top of the hot metal level.

3. The apparatus of claim 1 wherein the level of hot metal in the ingot mold is detected by one of (i) contacting and (ii) non-contacting automatic means for sensing the bottom of the hot top casting and the top of the hot metal level.

4. The apparatus of claim 1 further including means in the ingot weight determining means (b) for printing one or a combination of weight parameters in response to a print command signal generated when ingot pouring is completed.

* * * * *